US006603946B2

(12) United States Patent
Akema et al.

(10) Patent No.: US 6,603,946 B2
(45) Date of Patent: Aug. 5, 2003

(54) IMAGE FORMING APPARATUS FOR SYNTHETIC RESIN SHEETS

(75) Inventors: Hiroshi Akema, Shibata-gun (JP); Haruki Morikawa, Shibata-gun (JP); Masamune Koyanagi, Shibata-gun (JP); Noboru Onodera, Shibata-gun (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 72 days.

(21) Appl. No.: 09/855,490

(22) Filed: May 16, 2001

(65) Prior Publication Data

US 2002/0018675 A1 Feb. 14, 2002

(30) Foreign Application Priority Data

May 16, 2000 (JP) ..... 2000-142943
Jul. 26, 2000 (JP) ..... 2000-225319
Jul. 28, 2000 (JP) ..... 2000-229277

(51) Int. Cl.[7] ..... G03G 15/20
(52) U.S. Cl. ..... 399/320; 399/328
(58) Field of Search ..... 399/320, 322, 399/331, 328, 45, 67, 68

(56) References Cited

U.S. PATENT DOCUMENTS 3,637,976 A * 1/1972 Ohta et al.
4,017,173 A * 4/1977 Komori et al.
4,887,964 A * 12/1989 Takeuchi
5,436,431 A * 7/1995 Tsuji et al. ..... 399/328
5,493,380 A * 2/1996 Saitou et al. ..... 399/328
5,546,173 A * 8/1996 Hinotani et al. ..... 399/331
5,715,508 A * 2/1998 Berkers et al. ..... 399/328
5,991,555 A * 11/1999 Suzumi et al.
5,995,797 A * 11/1999 Shigeta et al. ..... 399/322
6,088,549 A * 7/2000 Kagawa et al. ..... 399/67
6,249,657 B1 * 6/2001 Kagawa ..... 399/67
6,449,457 B2 * 9/2002 Samei et al. ..... 399/328

FOREIGN PATENT DOCUMENTS

| | | | |
|---|---|---|---|
| JP | 05-212857 | | 8/1993 |
| JP | 7-181823 | * | 7/1995 |
| JP | 9-68879 | * | 3/1997 |
| JP | 11-167312 | | 6/1999 |
| JP | 11-305560 | | 11/1999 |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus including an image carrier for forming a toner image thereon. A conveyor conveys a synthetic resin sheet. An image transferring device transfers the toner image from the image carrier to the synthetic resin sheet being conveyed by the conveyor. A fixing device is located downstream of the image carrier in a direction of sheet conveyance for fixing the toner image transferred to the synthetic resin sheet. The fixing device includes a heat roller capable of contacting the synthetic resin sheet. The heat roller is freely rotatable and caused to rotate by the synthetic resin sheet being conveyed by the conveyor when the sheet contacts the heat roller.

13 Claims, 7 Drawing Sheets

IMAGE FORMING APPARATUS FOR SYNTHETIC RESIN SHEETS

BACKGROUND OF THE INVENTION

The present invention relates to a printer or similar electrophotographic image forming apparatus for forming images on optical disks or similar synthetic resin sheets. More particularly, the present invention relates to an image forming apparatus for forming a toner image on a synthetic resin sheet while conveying the sheet with a conveyor, and causing a fixing device to fix the toner image on the sheet with heat.

Today, an electrophotographic image forming apparatus capable of forming attractive full-color images on, e.g., paper sheets and OHP (Over Head Projector) sheets are extensively used. Further, there has been proposed in various forms an image forming apparatus of the type forming an image on one surface of an optical disk, e.g., a CD, (Compact Disk), a CD-RW (CD ReWritable), a LD (Laser Disk) or a DVD (Digital Versatile Disk) or similar synthetic resin sheet, e.g., on the protection layer surface of a CD. It has been customary with this type of image forming apparatus to use offset printing or screen printing. However, the problem with offset printing or screen printing is that a master corresponding to a desired image must be produced by an extra process beforehand. As a result, the apparatus lacks efficiency when producing many kinds of images or increases cost when producing a small number of images.

In light of the above, Japanese Patent Laid-Open Publication Nos. 5-212857 and 11-167312, for example, each propose an electrophotographic label printer for optical disks operable in the same manner as the traditional image forming apparatus for paper sheets or similar recording media. The label printer does not need masters and therefore the extra process for producing them. The electrophotographic image forming process includes an image forming step for transferring a toner image from an image carrier to a synthetic resin sheet, and a fixing step for fixing the toner image on the sheet. For the fixing step, use is made of a heat roller that heats the toner image carried on the synthetic resin sheet while pressing it against the sheet.

More specifically, the synthetic resin sheet carrying the toner image thereon is conveyed to a fixing position where the sheet contacts the heat roller over a preselected nip. At the fixing position, the heat roller heats the toner on the synthetic resin sheet while pressing it against the sheet. As a result, the toner image remains fixed on the synthetic resin sheet even after the sheet has moved away from the fixing position.

However, a series of experiments showed that the toner image formed on the synthetic resin sheet by the conventional apparatus suffered from irregularity, peeling, short gloss and other various defective fixation. We experimentally found that the defective fixation was ascribable to the following causes.

First, heat expected to cause the toner to melt during fixation is presumably short. A full-color image forming apparatus, for example, includes a fixing device made up of a heat roller and a backup roller pressed against the heat roller. The heat roller and backup roller each have a heater thereinside. These two rollers heat opposite sides of a paper sheet at the same time while conveying the paper sheet and can therefore sufficiently heat toner deposited on the paper sheet.

Assume that the above-described fixing device is used to fix a toner image formed on, e.g., the protection layer surface of an optical disk. Then, the backup roller, conveying the disk in cooperation with the heat roller, contacts the surface of the disk opposite to the projection layer surface (recording surface hereinafter). It is therefore likely that dust and other impurities deposited on the backup roller are transferred to the recording surface. Further, silicone oil or similar parting agent coated on the heat roller is transferred to the backup roller and therefore to the recording surface of the disk.

The impurities deposited on the recording surface of the disk, as stated above, obstruct the accurate read-out of data when the disk is played. It is therefore impractical to cause the backup roller to contact the recording surface of the disk or heat it. That is, the heat roller heats the protection layer surface of the disk alone. This is why the toner on the protection layer surface of the disk cannot be sufficiently heated, compared to toner on a paper sheet that can be heated from opposite sides, resulting in defective fixation.

Second, when a paper sheet is used as a recording medium, the toner melted by the heat roller can be pressed into gaps between the filaments of paper and therefore peels off little. However, it is difficult to fix toner on the surface of a disk or similar synthetic resin sheet that is smoother than the surface of a paper sheet. While the toner should therefore be sufficiently heated and firmly fixed on the synthetic resin sheet, heat for causing the toner to melt is locally short. This kind of defective fixation is likely to occur even with OHP sheets or simple plastic sheets.

Third, an optical disk or similar synthetic resin sheet has greater thermal capacity than, e.g., a paper sheet and cannot be heated as easily as a paper sheet. Specifically, the heat roller heats the disk either directly or via toner deposited on the disk. Therefore, a temperature difference between the disk and the toner during fixation is greater than a temperature difference between a paper sheet and toner. Consequently, heat fed from the heat roller to the toner is easily transferred to the disk, i.e., it cannot be efficiently fed to the toner. Moreover, the disk includes a metallic reflection layer having high thermal conductivity and adjoining the protection layer surface. The reflection layer extends over the entire disk and therefore has higher thermal conductivity than, e.g., a paper sheet, causing the heat fed from the heat roller to scatter. In this manner, for a given amount of heat, more heat is lost from the disk than from a paper sheet at a nip for fixation.

Even a synthetic resin sheet not including a reflection layer or similar layer having high thermal conductivity has greater thermal capacity than a paper sheet. This also results in the above-described defect.

To obviate defective fixation described above, higher fixing temperature may be assigned to a synthetic resin sheet than to, e.g., a paper sheet. This, however, aggravates power consumption. Alternatively, a longer fixing time for a unit area may be assigned to a synthetic resin sheet than to a paper sheet. This kind of scheme insures sufficient heat and thereby obviates the above occurrence. However, if the overall process speed for image formation is lowered in order to implement a long fixing time, then a period of time necessary for an image forming cycle increases, reducing the number of prints for a unit period of time.

Assume that the heat roller has a circumferential length greater than the length of a synthetic resin sheet in the direction of conveyance and therefore makes more than one rotation before the sheet arrived at the nip leaves the nip. This brings about another problem that a portion of the heat roller lost heat at the nip, i.e., lowered in temperature again contacts the surface of the synthetic resin sheet. Such a portion of the heat roller cannot sufficiently heat the synthetic resin sheet and therefore toner deposited thereon. This also results in defective fixation described above.

Moreover, defective fixation is apt to occur when the heat roller has an axial dimension in a direction perpendicular to the direction of conveyance that is smaller than the dimension of a synthetic resin sheet in the same direction. Such defective fixation may be obviated if the heat roller is provided with as large an area as possible in both of the circumferential and axial directions. This, however, requires the heat roller to be wastefully heated and is therefore undesirable from the energy consumption and space requirement standpoint.

On the other hand, in the image forming apparatus of the type causing the heat roller to contact a synthetic resin sheet, which is being conveyed by the conveyor, slip between the heat roller and the sheet disturbs the toner image carried on the sheet and thereby lowers image quality. To solve this problem, the peripheral speed of the heat roller and the conveying speed of the conveyor must be accurately matched to each other. However, when drive sources assigned to the heat roller and conveyor, respectively, are different in construction as conventional, it is difficult to accurately match the above two speeds. This is also true when the dimensional accuracy of a drive mechanism assigned to the heat roller is irregular.

While the above description has concentrated on a fixing member implemented as a heat roller, defective fixation is apt to occur even when the fixing member is implemented as, e.g., an endless belt.

Technologies relating to the present invention are also disclosed in, e.g., Japanese Patent Laid-Open Publication No. 11-305560.

SUMMARY OF THE INVENTION

It is a first object of the present invention to provide an electrophotographic image forming apparatus capable of fixing a toner image carried on a synthetic resin sheet or an optically writable, data recording medium over a period of time long enough to obviate defective fixation while producing as great a number of prints as possible.

It is a second object of the present invention to provide an electrophotographic image forming apparatus capable of fixing a toner image carried on a synthetic resin sheet or an optically writable, data recording medium while obviating wasteful energy consumption and saving space.

It is a third object of the present invention to provide an electrophotographic image forming apparatus capable of fixing a toner image carried on a synthetic resin sheet or an optically writable, data recording medium while accurately matching the peripheral speed of a heat roller and the conveying speed of a conveyor.

An image forming apparatus of the present invention includes an image carrier for forming a toner image thereon. A conveyor conveys a synthetic resin sheet. An image transferring device transfers the toner image from the image carrier to the synthetic resin sheet being conveyed by the conveyor. A fixing device is located downstream of the image carrier in a direction of sheet conveyance for fixing the toner image transferred to the synthetic resin sheet. The fixing device includes a heat roller capable of contacting the synthetic resin sheet. The heat roller is freely rotatable and caused to rotate by the synthetic resin sheet being conveyed by the conveyor when the sheet contacts the heat roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
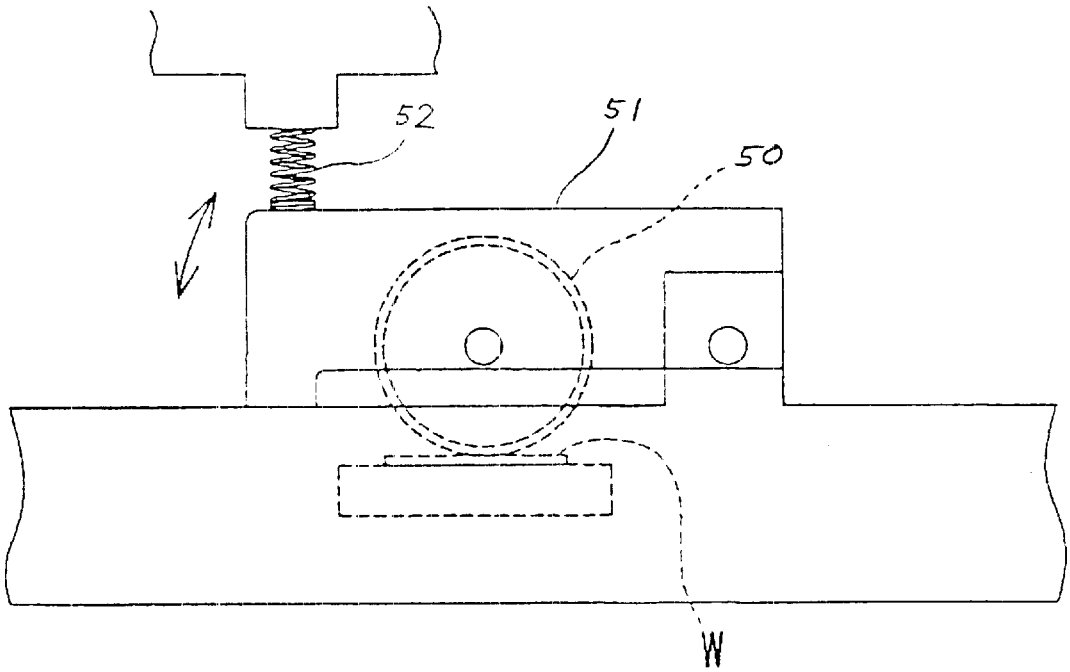
FIG. 1 is a fragmentary view showing an experimental fixing unit that we used before practicing the present invention

To better understand the present invention, brief reference will be made to an experimental fixing unit that we used before practicing the present invention, shown in FIG. 1. As shown, the fixing unit includes a pivotal arm 51 supporting a rotatable heat roller or fixing member 50. A spring 52 is anchored to the free end portion of the arm 51 at one end and to an apparatus body at the other end. The spring 52 constantly biases the heat roller 50 toward a synthetic resin sheet W. It was experimentally found that the heat roller 50 was apt to incline in the direction perpendicular to the sheet surface of FIG. 1 due to errors in the assembly including the arm 51. The inclination of the heat roller 50 resulted in an irregular pressure distribution in the axial direction of the roller 50 and therefore defective fixation.

Figure 2:
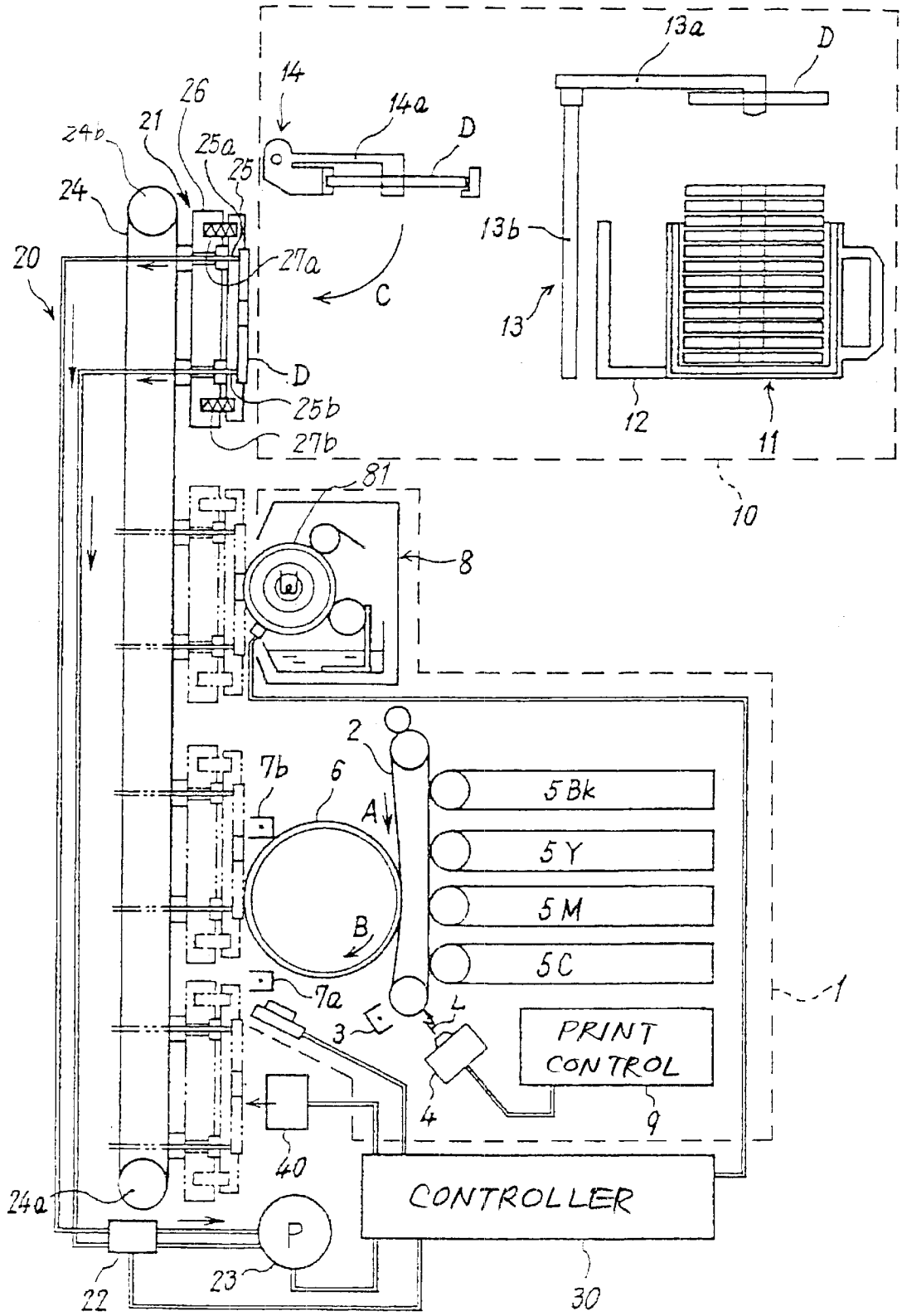
FIG. 2 is a view showing the general construction of a printer embodying the present invention.

Referring to FIG. 2, an image forming apparatus embodying the present invention is shown and implemented as an electrophotographic printer. This embodiment is mainly directed toward the first object stated earlier. The printer to be described is constructed to form images on CDs, CR-Rs, CD-RWs, LDs, DVDs and other synthetic resin sheets. As shown, the printer is generally made up of an image forming section 1, a disk storage 10, a disk conveyor 20, and a controller 30.

The image forming section 1 forms an image on an optical disk or similar recording medium (disk hereinafter) D in accordance with image data received from a computer, not shown, which is connected to the printer. The disk storage 10 stores disks D not processed and disks D processed. The disk conveyor or conveying means 20 conveys the disk D not processed from the disk storage 10 to a position where the image forming section 1 is expected to form an image. The disk conveyor 20 then conveys the disk D with a printed image from the image forming section 1 back to the disk storage 10. The controller or control means 30 controls the various sections of the printer.

The image forming section 1 includes a photoconductive belt 2, which is a specific form of an image carrier. Arranged around the belt 2 are a main charger or charging means 3, an optical writing unit or latent image forming means 4, four developing units or developing means 5C (cyan), 5M (magenta), 5Y (yellow) and 5Bk (black), and an intermediate transfer drum 6. The main charger 3 uniformly charges the surface of the belt 2. The optical writing unit 4 electrostatically forms a latent image on the charged surface of the belt 2. The developing units 5C, 5M, 5Y and 5Bk respectively develop latent images sequentially formed on the belt 2 with a cyan, a magenta, a yellow and a black developer. The resulting toner images of different colors are sequentially transferred to the intermediate transfer drum or body 6 one above the other, completing a full-color image. Let this image transfer be referred to as primary image transfer.

The image forming section 1 additionally includes transfer chargers or charge depositing means 7*a* and 7*b* and a fixing unit or fixing means 8. The transfer chargers 7*a* and 7*b* transfer the full-color image from the intermediate transfer drum 6 to the disk D by charging the disk D. Let this image transfer be referred to as secondary image transfer. The fixing unit 8 fixes the full-color image transferred to the disk D.

The operation of the above-described printer will be described in relation to the formation of a full-color image. In response to a print signal received from the computer, the belt 2 starts rotating in a direction indicated by an arrow in FIG. 2. At the same time, the main charger 3 starts uniformly charging the surface of the belt 2 to a preselected negative potential by corona discharge. The intermediate transfer drum 6 is rotated by the belt 3 at the same speed as the belt 2 in a direction indicated by an arrow B in FIG. 2. The optical writing unit 4 first cans the charged surface of the belt 2 with a laser beam L modulated in accordance with C image data, thereby forming a C latent image on the belt 2.

The developing unit C develops the C latent image with the C developer charged to negative polarity, thereby forming a C toner image on the belt 2. The C toner image is transferred from the belt 2 to the intermediate transfer drum 6 at a primary image transfer position where the belt 2 and drum 6 face each other. Specifically, a preselected electric field for primary transfer is formed at the primary image transfer position in synchronism with the conveyance of the C toner image. As a result, the C toner image is electrostatically transferred to the drum 6. A belt cleaner, not shown, cleans the surface of the belt 2 after the primary image transfer.

The writing unit 4 forms a M latent image on the belt 2 in parallel with the primary transfer of the C toner image to the intermediate transfer drum 6. The developing unit 5M develops the M latent image with the M developer. The resulting M toner image is transferred from the belt 2 to the intermediate image transfer drum 6 over the C toner image at the primary image transfer position. Subsequently, a Y and a Bk toner image are sequentially transferred to the intermediate transfer drum 6 in the same manner as the C and M toner images. Consequently, a full-color toner image is completed on the intermediate transfer drum 6.

The controller 30 controls the various operation timings of the image forming section 1, e.g., the write timing of the writing unit 4 and the timing for applying a bias for development. While the above description has concentrated on a full-color image, the printer is, of course, capable of forming a monochromatic image in, e.g., black or an image in two or three colors.

The disk storage 10 includes a feed box or image support body storing member 11, a collection box or image support body storing member 12, and a first and a second storing mechanism 13 and 14. The feed box 11 and collection box 12 store the disks D not processed and processed, respectively. The first and second storing mechanisms 13 and 14 pick up one unprocessed disk D from the feed box 11 at a time and feed it to the disk conveyor 20. Also, the storing mechanisms 13 and 14 pick up the processed disk D conveyed by the disk conveyor 20 and store it in the collection box 11. The position where the second storing mechanism 14 feeds the disk D to the disk conveyor 20 or picks it up from the disk conveyor 20 (feed/collection position hereinafter) is aligned with a fixing position assigned to the fixing unit 8 and the secondary image transfer position.

More specifically, a plurality of disks D are stacked on the feed box 11. A first robot arm 13*a* included in the first storing mechanism 13 picks up the top disk D, then makes half a rotation about a shaft 13*b*, and then hands it over to a second robot arm 14*a* included in the second storing mechanism 13. The second robot arm 14*a* angularly moves downward in a direction indicated by an arrow C in FIG. 2 to thereby set the disk D in the disk conveyor 20.

The disk conveyor 20 includes a holding mechanism 21 for holding the disk D. The holding mechanism 21 includes a table 25 having a support surface that is formed with a pair of suction ports 25*a* and 25*b*. The suction ports 25*a* and 25*b* are fluidly communicated to an air pump 23 via a pressure sensor 22. The air pump 23 sucks air via the suction ports 25*a* and 25*b*, causing the table 25 to hold the disk D. At this instant, the disk D has a recording surface contacting the support surface of the table 25 and a protection layer surface being exposed. The exposed surface of the disk D contacting the table 25 will be referred to as a front surface hereinafter. The holding mechanism 21 is affixed to a base plate 26, which is in turn affixed to a belt 24. A belt drive mechanism, not shown, drives the belt 24 such that the holding mechanism 21 moves back and forth in the up-and-down direction, as viewed in FIG. 2. The position of the table 25 indicated by a solid line in FIG. 2 will be referred to as a home position. The holding mechanism 21 will be described more specifically later.

Figure 3B:
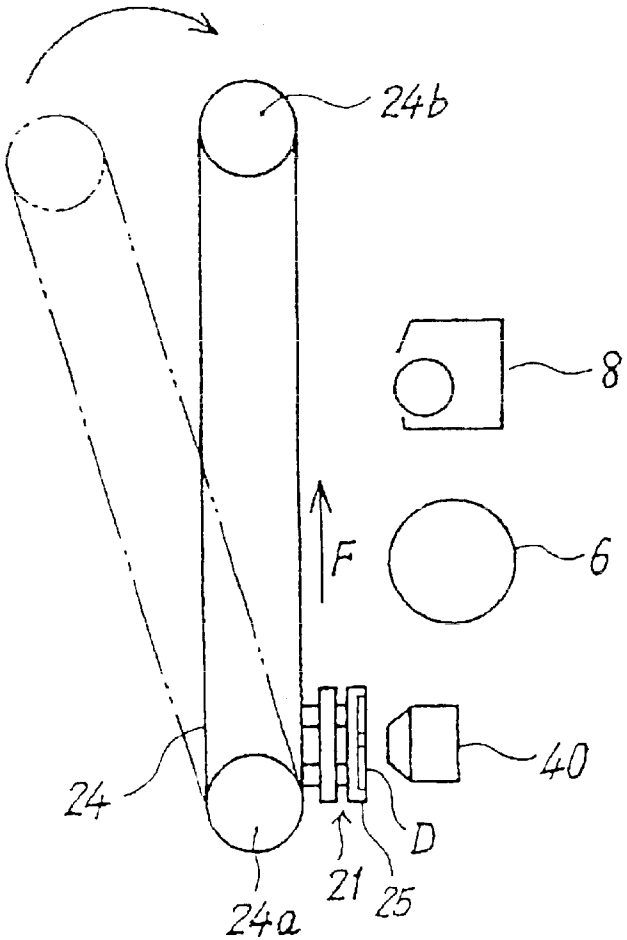
FIGS. 3A and 3B are views each showing a conveyor included in the illustrative embodiment in a particular position.
Figure 3A:
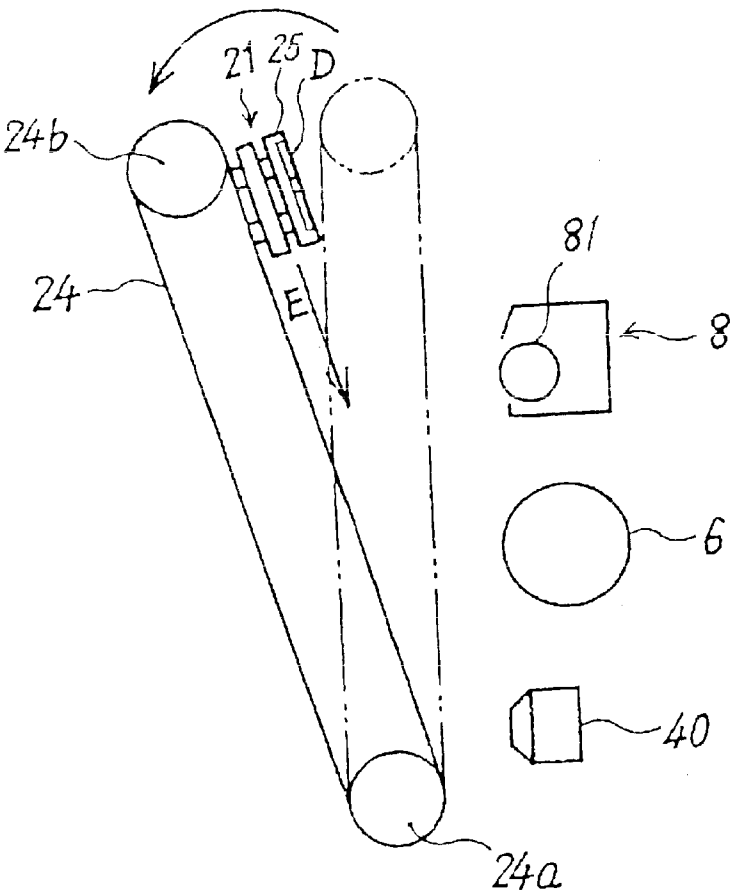

Reference will be made to FIGS. 3A and 3B for describing how the disk conveyor 20 conveys the disk D. As shown, the belt 24 is passed over a lower roller 24*a* and an upper roller 24*b*. A moving mechanism, not shown, causes the belt 24 to angularly move between a feed position and a return position, which are respectively indicated by a solid line in FIG. 3A and a solid line in FIG. 3B. After the second storing mechanism 14 has set the disk D on the table 25, the belt 24 is moved to the feed position. The belt drive mechanism causes the belt 24 and therefore the table 25 carrying the disk D to move toward the lower roller 24*a*, as indicated by an arrow E. At this instant, the belt 24 conveys the disk D along a path that does not adjoin or contact a heat roller or fixing member 81, which is included in the fixing unit 8, or the intermediate transfer drum 6.

After the table 25 has been conveyed to the lower roller 24*a*, the belt 24 is moved to the return position. Subsequently, the belt 24 conveys the table 25 backward toward the upper roller 24*b*, as indicated by an arrow F. At this instant, the previously mentioned front surface of the disk D adjoins or contacts the intermediate transfer drum 6 at the secondary image transfer position. The front surface of the disk D then adjoins or contacts the heat roller 81 at the fixing position. A front/rear distinguishing device 40 is located to face the disk D after the belt 24 has been shifted to the return position. Let the position where the front/rear distinguishing device 40 faces the disk D be referred to as a distinguishing position. The front/rear distinguishing device 40 determines whether or not the protection layer surface of the disk D is the front surface.

Assume that the protection layer surface of the disk D is the front surface (normal position), as determined by the front/rear distinguishing device 40. Then, the controller 30 causes the table 25 to move via the belt 24 in synchronism with the arrival of the leading edge of the full-color image formed on the intermediate transfer drum 6 at the secondary image transfer position. The chargers 7*a* and 7*b* are respectively positioned upstream and downstream of the secondary image transfer position in the direction of disk conveyance. The chargers 7*a* and 7*b* charge the front surface or protection layer surface of the disk D to positive polarity. As a result, an electric field for secondary image transfer is formed between the disk D and the intermediate transfer drum 6 at the secondary image transfer position. The electric field causes the full-color toner image to electrostatically move from the intermediate transfer drum 6 to the front surface of the disk D.

After the secondary image transfer to the disk D, the belt 24 conveys the table 25 and therefore the disk D to the fixing position where the heat roller 81 is positioned. The heat roller 81 contacts the front surface of the disk D for thereby fixing the toner image on the disk D with heat. Subsequently, the belt 24 conveys the disk D to the home position mentioned earlier. The first and second storing mechanisms 13 and 14 cooperate to pick up the disk D from the table 25 and collect it in the collection box 12.

Figure 4:
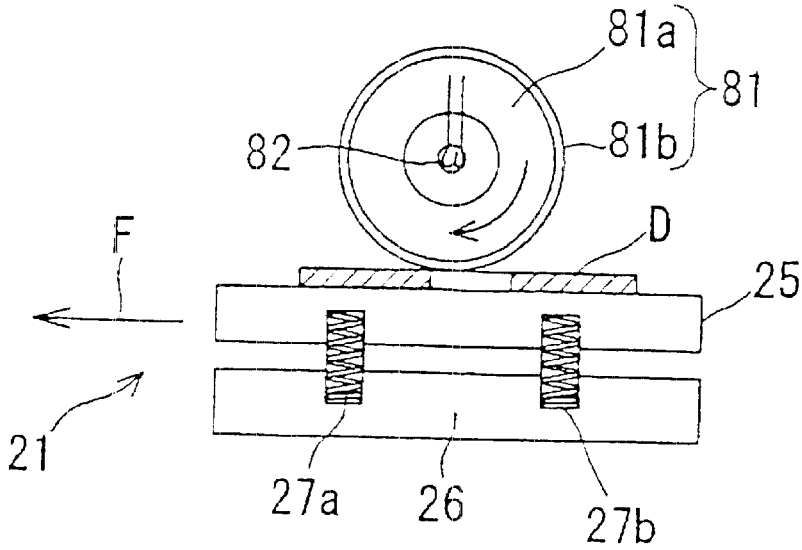
FIG. 4 is a side elevation showing a disk holding mechanism also included in the illustrative embodiment and being conveyed past a fixing position.
Figure 5:
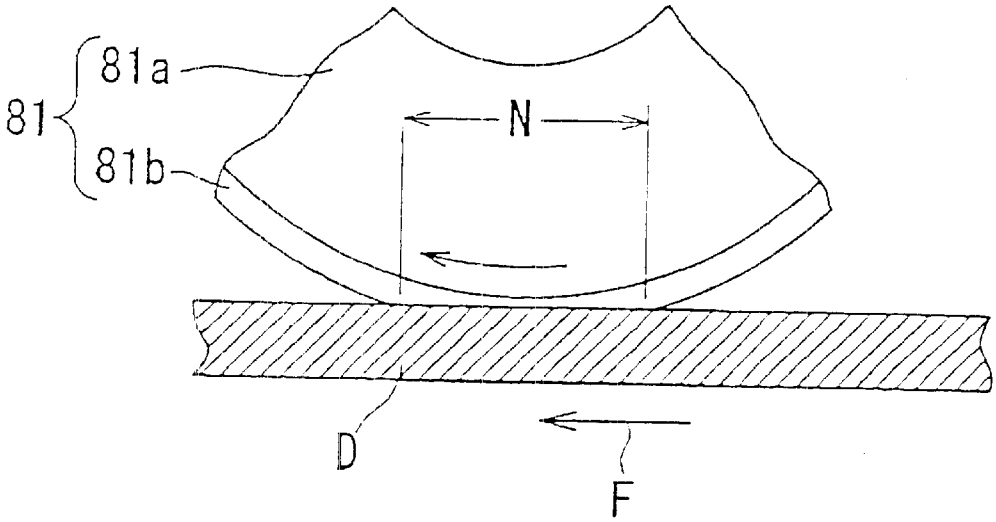
FIG. 5 is an enlarged view showing a nip formed between a heat roller and an optical disk shown in FIG. 4.

Arrangements unique to the illustrative embodiment will be described hereinafter. FIG. 4 shows the holding mechanism 21 being conveyed past the fixing position in the direction F. FIG. 5 shows a portion where the heat roller 81 and disk D contact each other. As shown in FIG. 4, the holding mechanism 21 includes a pair of springs 27*a* and 27*b* in addition to the table 25 and base plate 26. The springs 27*a* and 27*b* allow the support surface of the table 25 to elastically move relative to the heat roller 81. The holding mechanism 21 can therefore convey the disk D while holding the disk D such that its front surface is elastically movable relative to the heat roller 81.

The heat roller 81 is made up of a hollow cylindrical roller 81*a* formed of, e.g., aluminum and an elastic layer 81*b* covering the surface of the roller 81*a* and formed of rubber. The heat roller 81 is journalled to opposite side walls, not shown, included in the printer body via bearings not shown. That is, the heat roller 81 is rotatable at a fixed position inside the printer body. A heater 82 is disposed in the roller 81*a*.

The table 25 holds the disk D such that the disk D overlaps, in an unstressed condition in which the front surface is not displaced, the circumference of the heat roller 81 at the side where the axis of the roller 81 is positioned. At the fixing position, the heat roller 81 and disk D contact each other. At this instant, the disk D and table 25 holding it move toward the base plate 26 against the action of the springs 27*a* and 27*b*. In this condition, pressure acts between the heat roller 81 and the disk D. Consequently, as shown in FIG. 5, the elastic layer 81*b* of the heat roller 81 elastically yields and forms a nip between it and the disk D. The nip has a preselected width N great enough to guarantee a period of time for sufficiently heating the toner on the disk D.

The heat roller 81 is held in a fixed position inside the printer body. The heat roller 81 is therefore free from the problem discussed earlier with reference to FIG. 1. In addition, the heat roller 81 reduces the number of parts and therefore cost, compared to the configuration shown in FIG. 1.

One or both of the spring constant of the springs 27*a* and 27*b* and the length of the same in an unstressed condition is variable. This allows the pressure to act between the disk D and the heat roller 81 and therefore the nip width N to be varied, i.e., the duration of fixation is adjustable, as desired.

As stated above, the illustrative embodiment insures a sufficient period of time for fixation in relation to the disk D, which suffers from defective fixation more than, e.g., a paper sheet. Further, the illustrative embodiment completes the entire image forming process in as short a period of time as possible and guarantees desirable fixation with the heat roller 81 fixed in place.

The heat roller 81 playing the role of a fixing member may be replaced with a fixing belt, if desired. With a fixing belt, it is possible to set a desired nip width and therefore a desired duration of fixation without regard to the pressure.

The above description has concentrated on a printer of the type sequentially effecting primary image transfer and secondary image transfer. Alternatively, the image forming section 1 may be implemented by the configuration of a conventional image forming section dealing with, e.g., paper sheets.

In the illustrative embodiment, the springs 27*a* and 27*b* are used to allow the support surface of the table 25 to elastically move relative to the heat roller 81. If desired, the springs 27*a* and 27*b* may be replaced with rubber or similar elastic material, as will be described hereinafter with reference to FIG. 6.

Figure 6:
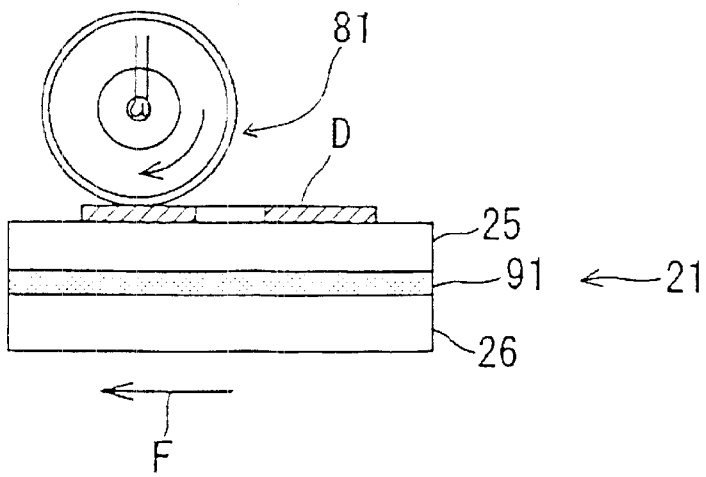
FIG. 6 is a side elevation showing a modification of the illustrative embodiment.

FIG. 6 shows the holding mechanism 21 being conveyed past the fixing position in the direction F. As shown, an elastic member 91 intervenes between the table 25 and the base plate 26. The elastic member 91 may be formed of silicone rubber or urethane rubber by way of example. The elastic member 91 elastically deforms to allow the support surface of the table 25 and therefore the front surface of the disk D to move relative to the heat roller 81. This modification achieves the same advantages as the illustrative embodiment.

Figure 7:
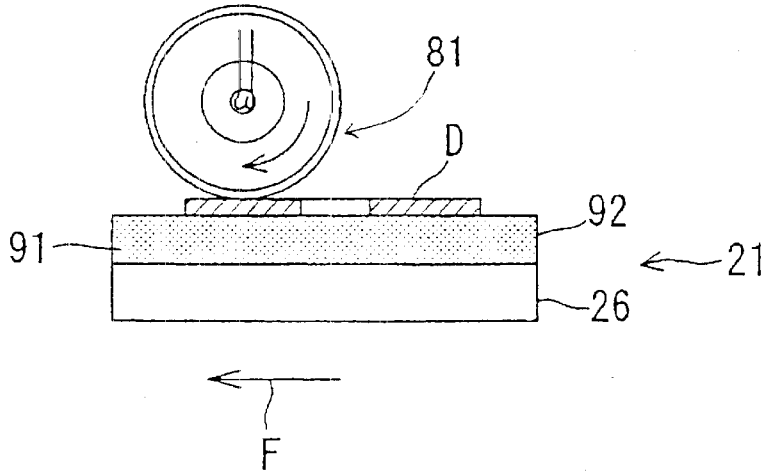
FIG. 7 is a side elevation showing another modification of the illustrative embodiment.
Figure 8:
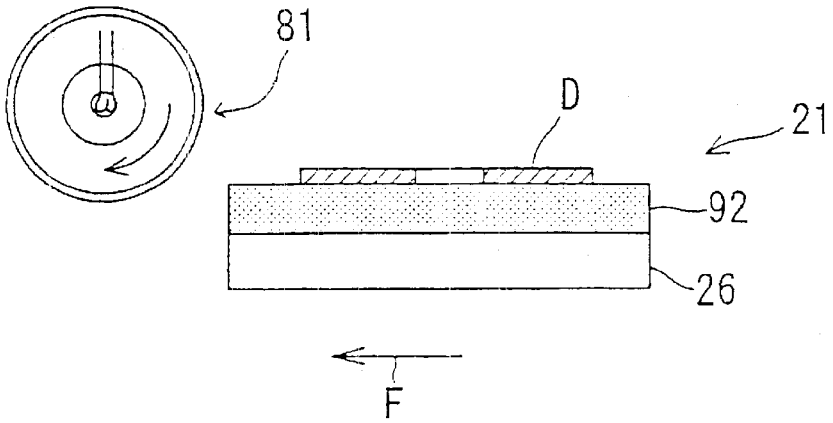
FIG. 8 is a side elevation showing still another modification of the illustrative embodiment.

In the illustrative embodiment, the table 25 holds the disk D. FIG. 7, which is similar to FIG. 6, shows another modification of the illustrative embodiment that does not include the table 25. FIG. 8 shows the holding mechanism 21 being conveyed toward the fixing position in the direction F. As shown in FIG. 7, in the holding mechanism 21, an elastic member 92 is mounted on the base plate 26 and directly holds the disk D. The elastic member 21 has thickness that allows preselected pressure to act at the fixing position. The elastic member 92 may also be formed of silicone rubber or urethane rubber.

As shown in FIG. 8, when the elastic member 92 is in an unstressed position, the disk D and elastic member 92 partly overlap the circumference of the heat roller 81 at the side where the axis of the roller 81 is positioned. On the other hand, the base plate 26 is positioned at the side opposite to the above-mentioned side with respect to the circumference of the roller 81 and does not overlap the roller 81. When the holding mechanism 21 moves toward the heat roller 81 in the direction F, the leading corner of the elastic member 92 first contacts the circumference of the heat roller 81 while elastically yielding. This protects the circumference of the heat roller 81 from damage. Should the base plate 26 overlap the circumference of the heat roller 81, the leading corner of the base plate 26 would first contact the circumference and damage it. In this manner, this modification, which does not include the table 25, reduces the number of parts and therefore cost while protecting the heat roller 81 from damage.

As stated above, the illustrative embodiment and modifications thereof have various unprecedented advantages, as enumerated below.

(1) The synthetic resin sheet and fixing member contact each other over a preselected nip width. The nip width guarantees a sufficient period of time for the toner to be heated and therefore insures desirable fixation, compared to a case wherein the sheet and fixing member linearly contact without any nip width. Further, the entire image forming process completes in a short period of time and allows as great a number of prints as possible to be output, compared to a case wherein the entire process speed is lowered to implement a long fixing time.

(2) Heat and pressure cooperate to fix the toner on the synthetic resin sheet and therefore fix it more efficiently than when only heat is used.

(3) The heat roller is supported by a minimum number of parts and therefore free from the accumulation of assembly errors, compared to a case wherein the heat roller is supported by, e.g., the pivotal arm. This successfully obviates an irregular pressure distribution in the axial direction of the heat roller ascribable to assembly errors and thereby insures desirable fixation. In addition, the number of parts and therefore cost is reduced.

(4) The outer periphery of the heat roller is protected from damage.

An alternative embodiment of the present invention, which is mainly directed toward the second object stated earlier and also implemented as an electrophotographic printer, will be described hereinafter. This embodiment and previous embodiment are similar to each other as to construction and operation as well as the disk D, so that the following description will concentrate on differences between them.

Generally, a backup roller customarily with the transfer of a toner image to a paper sheet or similar recording medium is not desirable when it comes to the optical disk or similar synthetic resin sheet D. This is because impurities and a parting agent are likely to deposit between the writing surface of the disk D and the backup roller, obstructing the read-out of data. The heat roller 81 should therefore sufficiently heat toner alone. Also, toner to be fixed on the surface of the disk D, which is smoother than a paper sheet, must be sufficiently heated. Further, in the case of image transfer to the disk D, heat generated by the heat roller 81 is presumably lost at the nip, where the roller 81 contacts the disk D, more than in the case of image transfer to a paper sheet. Consequently, when a portion of the heat roller 81 contacted the disk D and cooled off thereby again contacts it at the downstream side in the direction of conveyance, defective fixation occurs due to low temperature. Moreover, the heat roller 81 cannot evenly heat the entire disk D unless it has an axial length greater than the width of the disk D in the direction perpendicular to the direction of conveyance.

For the reasons described above, the entire disk D should preferably contact the surface of the heat roller 81 while the heat roller 81 makes one rotation. On the other hand, the heater disposed in the heat roller 81 consumes more power as the surface area of the heat roller 81 increases. In this respect, the size of the heat roller 81 should preferably be limited.

Figure 10:
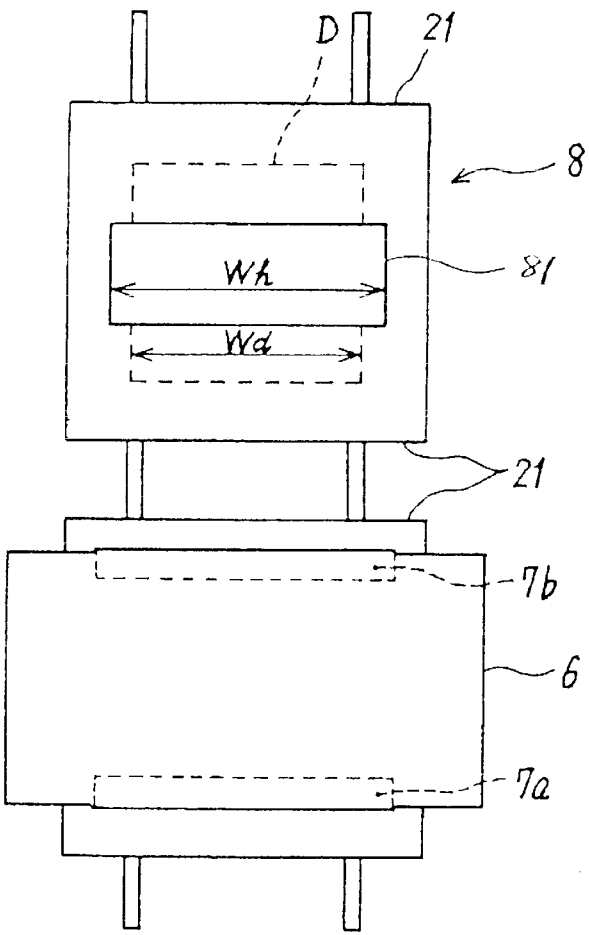
FIG. 10 is a front view of a fixing unit included in the embodiment of FIG. 9.
Figure 9:
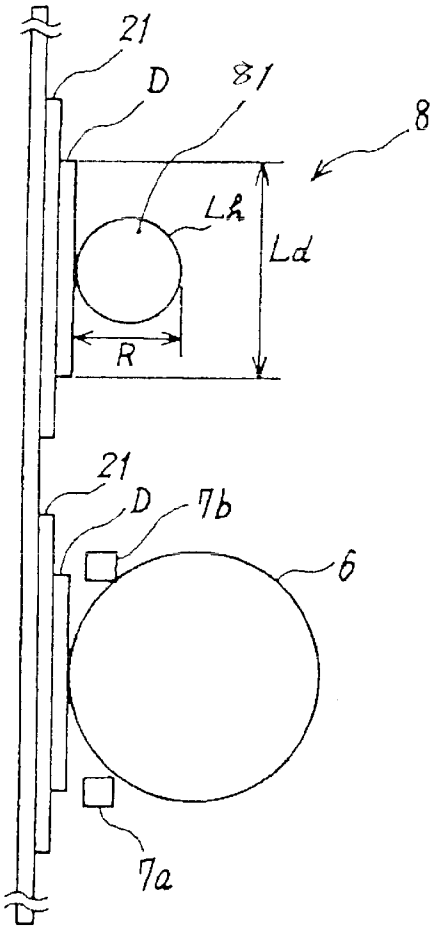
FIG. 9 is a sectional view showing an alternative embodiment of the present invention in a plane perpendicular to the axis of the heat roller.

To meet the above requirements, the illustrative embodiment determines the configuration of the heat roller 81 in accordance with the size of the disk or recording medium, as will be described with reference to FIGS. 9 and 10. As shown in FIG. 9, the heat roller 81 has a circumferential length Lh selected to be equal to or greater than the length Ld of the disk D in the direction of conveyance, but equal to or smaller than Ld+30 mm. Also, as shown in FIG. 10, the heat roller 81 has an axial width Wh, which corresponds to the nip, equal to or greater than the width Wd of the disk D in the direction perpendicular to the direction of conveyance, but equal to or smaller than Wd+30 mm.

Examples 1 through 4 to be described hereinafter each show a particular diameter R and a particular axial width Wh of the heat roller 81 selected for a particular synthetic resin sheet size. In Examples 1 through 4, the axial width Wh of the heat roller 81 has an upper limit selected to be Wd+20 mm in order to save both of energy and space.

EXAMPLE 1

The synthetic resin sheet D was implemented as a CD or similar disk having a diameter of 120 mm. The heat roller 81 was provided with a diameter R of 41.4 mm (circumferential length nearly equal to 130 mm) and an axial width Wh of 130 mm. This was successful to satisfy the following relations:

$$Ld \leqq Lh \leqq Ld+30\ mm \quad (1)$$

$$Wd \leqq Wh \leqq Wd+20\ mm \quad (2)$$

EXAMPLE 2

The synthetic resin sheet D was implemented as a CD or similar disk having a diameter of 80 mm. The heat roller 81 was provided with a diameter R of 28.7 mm (circumferential length nearly equal to 90 mm) and an axial width Wh of 90 mm. This also satisfied the relations (1) and (2).

EXAMPLE 3

The synthetic resin sheet D was implemented as a card that was 60 mm long (Ld) and 80 mm wide (Wd). The heat roller 81 was provided with a diameter R of 22.3 mm (circumferential length nearly equal to 70 mm) and an axial width Wh of 90 mm. This also satisfied the relations (1) and (2).

EXAMPLE 4

The synthetic resin sheet D was implemented as a card that was 80 mm long (Ld) and 60 mm wide (Wd). The heat roller 81 was provided with a diameter R of 28.7 mm (circumferential length nearly equal to 90 mm) and an axial width Wh of 70 mm. This also satisfied the relations (1) and (2).

The cards used in Examples 3 and 4 may be implemented as card type CD-Rs (CD-Readable) belonging to a family of card type optical recording media.

In the configurations of Examples 1 through 4, the same portion of the heat roller 81 does not contact the synthetic resin sheet two times during fixation. Therefore, temperature necessary for fixation is maintained at the nip, obviating defective image transfer. Further, the heat roller 81 has its circumferential length Lh and axial width Wd confined in the above-described ranges and is therefore relatively small. In addition, such dimensions obviate wasteful energy consumption and reduce the overall size of the fixing unit 8.

The dimensions of Examples 1 through 4 are only illustrative. For example, in Example 1, the heat roller 81 may be provided with a diameter R of 41.0 mm and therefore a circumferential length Lh equal to or smaller than Ld+10 mm, further promoting energy saving and size reduction.

The heat roller 81 playing the role of a fixing member may, of course, be replaced with, e.g., a belt having an endless, movable surface and capable of fixing a toner image with heat.

As described above, the illustrative embodiment has various unprecedented advantages, as enumerated below.

(1) The fixing member stably, evenly feeds heat necessary for fixation to the entire surface of a synthetic resin sheet. Therefore, a toner image transferred to the sheet is free from irregularity, peeling, short gloss and other defects and therefore attractive.

(2) The fixing member can heat the sheet with a minimum of energy. This, coupled with the fact that the size of the fixing member is not excessively great, saves energy and space when a toner image is electrophotographically formed on the sheet. In addition, such a fixing member reduces the size of the fixing device and therefore the overall size of the image forming apparatus.

(3) The surface of the fixing member covers the entire width of the sheet in the direction perpendicular to the direction of conveyance. This successfully obviates defective fixation of a toner image electrophotographically formed on the sheet.

Figure 11:
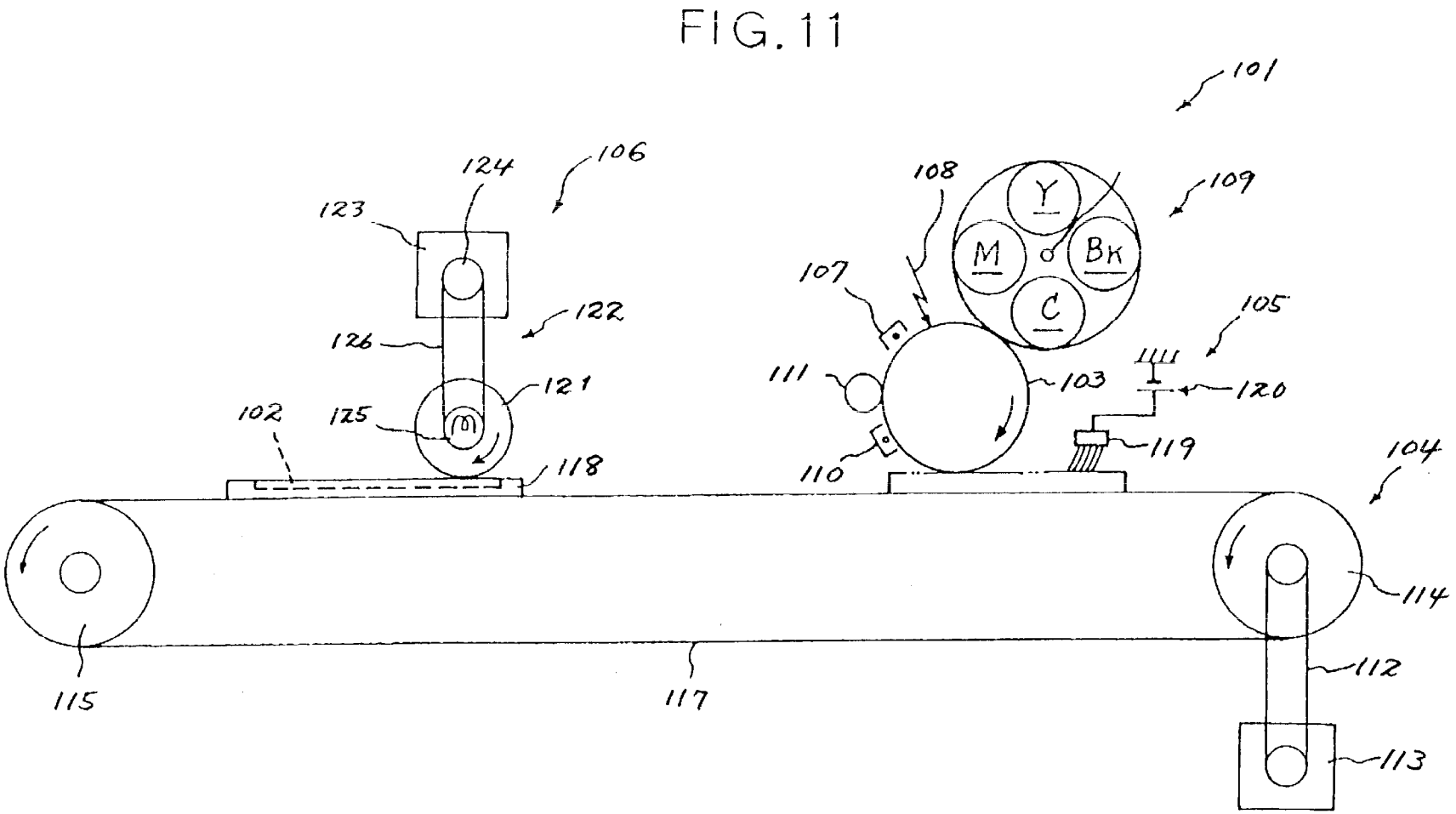
FIG. 11 is a view showing another alternative embodiment of the present invention.

Another alternative embodiment of the present invention, which is mainly directed toward the third object stated earlier and also implemented as an electrophotographic printer, will be described with reference to FIG. 11. As shown, the printer, generally 101, includes a photoconductive drum or image carrier 103. A conveyor 104 conveys a synthetic resin sheet 102. An image transferring device 105 transfers a toner image from the drum 103 to the sheet 102 being conveyed by the conveyor 104. A fixing unit 106 is positioned downstream of the drum 103 in the direction of conveyance of the conveyor 104 for fixing the toner image on the sheet 102. A charger 107 uniformly charges the surface of the drum 103. An exposing unit, not shown, scans the charged surface of the drum 103 with a laser beam 108 for thereby forming a latent image. A developing unit 109 develops the latent image with toner to thereby produce a corresponding toner image. A discharger 110 discharges the surface of the drum1 103 after the transfer of the toner image to the sheet 102. A cleaner 111 removes toner left on the drum 103 that has been discharged by the discharger 110.

The conveyor 104 includes a drive roller 114 driven by a motor 113 via a belt 112. An endless belt 117 is passed over the drive roller 114 and a driven roller 115. A tray 118 is affixed to the belt 117 and formed with a recess. The tray 118 is movable with the sheet 102 being received in the recess. The recess has a depth substantially equal to the thickness of the sheet 102, so that the top of the sheet 102 is substantially flush with the top of the tray 118.

The image transferring device 105 includes a brush 119 that slidingly contacts the sheet 102 being conveyed by the conveyor 104. A voltage applying means 120 is connected to the brush 119 at one end and to ground at the other end. The voltage applying means 120 applies preselected voltage opposite in polarity to toner to the brush 119. The brush 119 charges the sheet 102 to polarity opposite to the polarity of toner on the basis of the above voltage. The drum 103 is spaced from the belt 117 by a preselected gap so as to contact the sheet 102 being conveyed by the conveyor 104.

The developing unit 109, which is implemented as a revolver, includes four developing sections respectively assigned to yellow, magenta, cyan and black. The revolver 109 rotates about a shaft 116 to bring any one of the developing sections to a developing position where the developing section faces the drum 103. To form a color image, toner images are sequentially formed on the drum 103 one above the other and then collectively transferred to the sheet 102. The drum 103 may be replaced with an endless photoconductive belt, if desired.

The fixing unit 106 includes a heat roller 121 spaced from the belt 117 by a preselected gap so as to contact the sheet 102 being conveyed by the conveyor 104. A drive mechanism 122 causes the heat roller 121 to rotate and includes a motor 123, an endless belt 126 passed over the output shaft 124 of the motor 123 and the shaft 125 of the heat roller 121, and a one-way clutch not shown. A heat roller, not shown, is disposed in the shaft 125 for generating an amount of heat great enough to fix toner on the sheet 102. The motor 123 causes the heat roller 121 to rotate via the belt 126 in the same direction as the sheet 102, as seen at a position where the heat roller 121 and sheet 102 face each other.

In the illustrative embodiment, the heat roller 121 rotates at a peripheral speed that is 80% of the speed at which the conveyor 104 conveys the sheet 102. The one-way clutch allows the heat roller 121 to rotate by being driven by the sheet 102 when the sheet 102 contacts the roller 121. The peripheral speed of the heat roller 121 being driven by the motor 123 should be lower than the conveying speed of the conveyor 104, i.e., the rotation speed of the heat roller 121 being driven by the sheet 102; preferably, the former should be equal to or higher than 50%, but lower than 100%, of the latter. Experiments showed that such a range prevented the heat roller 121 from disturbing a toner image carried on the sheet 102 when driven by the sheet 102.

The printer 101 additionally includes a disk feeder and a disk collector although not shown specifically. The disk feeder and disk collector are respectively positioned upstream of the image transferring device 105 and downstream of the fixing unit 106 in the direction of conveyance. The disk feeder feeds the sheet 102 to the tray 118 while the disk collector picks up the sheet 102 from the tray 118 after fixation.

The operation of the printer 101 will be described hereinafter. When the operator of the printer 101 presses a start switch provided on an operation panel, not shown, a scanner, not shown, scans a document while the disk feeder feeds the sheet 102 to the tray 118. At this instant, the tray 118 is positioned at an inlet located upstream of the image transferring device 105. A toner image is formed on the drum 103 in accordance with an image signal representative of the document by a conventional process. Subsequently, the motor 113 is energized to convey the sheet 102 toward the drum 103 in synchronism with the rotation of the drum 103. At this time, the image transferring device 105 charges the surface of the sheet 102 to polarity opposite to the polarity of the toner. As soon as the sheet 102 arrives at the drum 103, the toner image is transferred from the drum 103 to the sheet 102. The toner image is surely transferred to a desired position on the sheet 102 because the conveyance of the sheet 102 is synchronous to the rotation of the drum 103.

When the leading edge of the tray 118 contacts the heat roller 121, the former causes the latter to rotate because the one-way clutch is uncoupled at this time. More specifically, the heat roller 121 contacts the sheet 102 and is driven thereby at a peripheral speed equal to the conveying speed of the sheet 102. This allows the toner image on the sheet 102 to be desirably fixed without any disturbance. When the sheet 102 arrives at an outlet located downstream of the fixing unit 106, the disk collector picks up the sheet 102 from the tray 118. Subsequently, the motor 113 is reversed in order to return the tray 118 to the inlet, so that the tray 118 can be loaded with another sheet 102. As soon as a desired number of sheets 102 input on the operation panel are dealt with, the operation of the printer 101 ends.

The drive mechanism 122 of the illustrative embodiment is not essential. An arrangement may alternatively be made such that only the sheet 102 causes the heat roller 121 to rotate on contacting it. In this arrangement, the heat roller 121 should preferably be light weight and encounters a minimum of resistance to rotation in order to accurately follow the movement of the sheet 102. If desired, the sheet 102 may have greater height than the tray 118 so as to contact the heat roller 121 alone. The crux is that the heat roller 121 follows at least the rotation of the sheet 102. In such a case, heat is not transferred from the heat roller 121 to the tray 118, enhancing thermal efficiency. Because the leading edge of the tray 118 does not rotate the heat roller 121 before the sheet 102, it is preferable to reduce, whether or not the drive mechanism 122 may be present, the weight of the heat roller 121 and resistance to rotation.

The printer 101 may additionally include an intermediate image transfer belt, in which case toner images will be transferred from the drum 103 to the belt one above the other and then collectively transferred to the sheet 102. The brush 119 included in the charging device 105 may be replaced with a conductive sheet or a conductive roller, if desired. Further, the tray 118 may be configured to be loaded with two or more sheets 102 side by side in the direction of conveyance or in the direction perpendicular thereto, as desired.

As stated above, in the illustrative embodiment, the heat roller is freely rotatable and driven by the synthetic resin sheet when the latter contacts the former. Therefore, a simple arrangement not including a mechanism for driving the heat roller can accurately match the peripheral speed of the heat roller and the conveying speed of the sheet. A toner image can therefore be transferred to the sheet with high quality. Further, the heat roller rotates, when driven by the drive mechanism, at a speed equal to or higher than 50%, but lower than 100%, of the rotation speed of the same when driven by the sheet. This allows the heat roller to accurately follow the movement of the sheet and thereby further enhances image quality.

Various modifications will become possible for those skilled in the art after receiving the teachings of the present disclosure without departing from the scope thereof.

What is claimed is:

1. An image forming apparatus comprising:

means for conveying a synthetic resin sheet, including a resin sheet holding mechanism;

means for forming an image on a surface of the synthetic resin sheet, which is being conveyed by said conveying means, with toner; and means for fixing the toner on the synthetic resin sheet being conveyed by said conveying means with heat, said means for fixing including a fixing member whose surface is endlessly movable;

wherein the surface of the synthetic resin sheet and the surface of said fixing member contact each other over a preselected width in a direction of sheet conveyance.

2. The apparatus as claimed in claim 1, wherein said fixing member comprises a heat roller having an elastic surface.

3. The apparatus as claimed in claim 2, further comprising pressing means for exerting pressure for fixation between the synthetic resin sheet and said heat roller.

4. The apparatus as claimed in claim 3, wherein said heat roller is rotatable at a fixed position inside a body of said apparatus; and wherein said conveying means includes an elastic body.

5. The apparatus as claimed in claim 4, wherein said elastic body elastically supports the synthetic resin sheet such that the surface of said synthetic resin sheet is elastically displaceable relative to the surface of said heat roller, and such that in an unstressed condition said surface of said synthetic resin sheet is positioned at a side where an axis of said heat roller is positioned with respect to said surface of said heat roller.

6. The apparatus as claimed in claim 5, wherein said conveying means comprises a support member supporting said elastic body that, in turn, holds the synthetic resin sheet; and wherein in an unstressed condition said elastic body is at least partly positioned at said side while said support member is positioned at a side opposite to said side.

7. In an image forming apparatus including a fixing member whose surface is endlessly movable and causing a synthetic resin sheet, which is a data recording medium and being conveyed at a same speed and in a same direction as a surface of said fixing member, to contact said surface of said fixing member to thereby fix a toner image formed on said synthetic resin sheet, said surface of said fixing member has a dimension in a direction of endless movement that is equal to or greater than a dimension of said synthetic resin sheet in a direction of sheet conveyance.

8. The apparatus as claimed in claim 7, wherein the dimension of the surface of said fixing member is equal to or smaller than the dimension of the synthetic resin sheet plus 30 mm.

9. An image forming apparatus comprising:

conveying means for conveying a synthetic resin sheet, which is a data recording medium;

image forming means for forming a toner image on a surface of the synthetic resin sheet being conveyed by said conveying means; and fixing means including a fixing member whose surface is endlessly movable and causing the synthetic resin sheet, which is being conveyed at a same speed and in a same direction as a surface of said fixing member, to contact said surface of said fixing member to thereby fix the toner image formed on said synthetic resin sheet;

wherein the surface of said fixing member has a dimension in a direction of endless movement that is equal to or greater than a dimension of said synthetic resin sheet in a direction of sheet conveyance.

10. The apparatus as claimed in claim 9, wherein the dimension of the surface of said fixing member is equal to or smaller than the dimension of the synthetic resin sheet plus 30 mm.

11. An image forming apparatus comprising:

an image carrier configured to form a toner image thereon;

a conveyor constructed to convey a synthetic resin sheet;

an image transferring device configured to transfer the toner image from the image carrier to the synthetic resin sheet being conveyed by the conveyor; and a fixing device located downstream of said image carrier in a direction of sheet conveyance and configured to fix the toner image transferred to the synthetic resin sheet, said fixing device including a heat roller capable of contacting said synthetic resin sheet;

wherein said heat roller is freely rotatable and caused to rotate by the synthetic resin sheet being conveyed by said conveyor when said synthetic resin sheet contacts said heat roller.

12. An image forming apparatus comprising:

a conveyor having a synthetic resin sheet holding mechanism and constructed to convey a synthetic resin sheet;

an image forming section constructed to form an image on a surface of the synthetic resin sheet, which is being conveyed by said conveyor, with toner; and a fixing device including a fixing member, whose surface is endlessly movable, and configured to fix the toner on the sheet being conveyed by said conveyor with heat;

wherein the surface of the synthetic resin sheet and the surface of said fixing member contact each other over a preselected width in a direction of sheet conveyance.

13. An image forming apparatus comprising:

a conveyor constructed to convey a synthetic resin sheet, which is a data recording medium;

an image forming section constructed to form a toner image on a surface of the synthetic resin sheet being conveyed by said conveyor; and a fixing device including a fixing member whose surface is endlessly movable and constructed to cause the synthetic resin sheet, which is being conveyed at a same speed and in a same direction as a surface of said fixing member, to contact said surface of said fixing member to thereby fix the toner image formed on said synthetic resin sheet;

wherein the surface of said fixing member has a dimension in a direction of endless movement that is equal to or greater than a dimension of said synthetic resin sheet in a direction of sheet conveyance.

* * * * *